US010964167B2

(12) United States Patent
Oyama et al.

(10) Patent No.: US 10,964,167 B2
(45) Date of Patent: Mar. 30, 2021

(54) INFORMATION PROCESSOR AND RECORDING MEDIUM STORING GAME PROGRAM

(71) Applicant: Universal Entertainment Corporation, Tokyo (JP)

(72) Inventors: Masaki Oyama, Tokyo (JP); Toshikazu Jinnouchi, Tokyo (JP)

(73) Assignee: UNIVERSAL ENTERTAINMENT CORPORATION, Tokyo (JP)

( * ) Notice: Subject to any disclaimer, the term of this patent is extended or adjusted under 35 U.S.C. 154(b) by 30 days.

(21) Appl. No.: 16/565,660

(22) Filed: Sep. 10, 2019

(65) Prior Publication Data

US 2020/0111318 A1 Apr. 9, 2020

(30) Foreign Application Priority Data

Oct. 5, 2018 (JP) ..... JP2018-190087

(51) Int. Cl.
*G07F 17/32* (2006.01)
*G07F 17/34* (2006.01)

(52) U.S. Cl.
CPC ..... *G07F 17/3267* (2013.01); *G07F 17/3213* (2013.01); *G07F 17/34* (2013.01)

(58) Field of Classification Search
CPC ..... G07F 17/3267; G07F 17/34
See application file for complete search history.

(56) References Cited

U.S. PATENT DOCUMENTS

2008/0020826 A1* 1/2008 Holch ..... G07F 17/3255 463/25
2008/0045344 A1* 2/2008 Schlottmann ..... G07F 17/32 463/42
2013/0190075 A1* 7/2013 Chun ..... G07F 17/322 463/25
2014/0087846 A1* 3/2014 Bryan ..... G07F 17/3267 463/25
2018/0365930 A1* 12/2018 Yamaguchi ..... G07F 17/3244
2020/0105105 A1* 4/2020 Bolton ..... G07F 17/3223

* cited by examiner

*Primary Examiner* — Jay Trent Liddle
(74) *Attorney, Agent, or Firm* — Lex IP Meister, PLLC

(57) ABSTRACT

An information processor which provides a game in which a benefit is awarded as a result of random determination to a terminal device over a communication line executes the processes of: (a) receiving, from the terminal device, a result of the random determination of determining content of the benefit, which is sent each time the random determination is executed; (b) storing, in the storage unit, the result of the random determination received in the process (a); (c) when a game acceleration instruction for accelerating progress of the game is made in the terminal device, receiving results of a predetermined number of times of execution of the random determination, which are sent together from the terminal device; and (d) storing, in the storage unit, the results of the predetermined number of times of execution of the random determination, which are received in the process (c).

3 Claims, 11 Drawing Sheets

FIG.5

SYMBOL ARRAYS OF VIDEO REELS

| | REEL 1 | REEL 2 | REEL 3 | REEL 4 | REEL 5 |
|---|---|---|---|---|---|
| 0 | HEART | 9 | CHERRY | 9 | KING |
| 1 | CHERRY | JACK | KING | JACK | ACE |
| 2 | 7 | HEART | 9 | WILD | BELL |
| 3 | JACK | 7 | ACE | 9 | KING |
| 4 | KING | 10 | BELL | JACK | BONUS |
| 5 | WATERMELON | 9 | 10 | HEART | WATERMELON |
| 6 | 10 | ACE | WATERMELON | KING | QUEEN |
| 7 | BELL | BELL | 10 | JACK | HEART |
| 8 | JACK | JACK | CHERRY | 10 | JACK |
| 9 | 9 | WATERMELON | 10 | BELL | 9 |
| 10 | ACE | 9 | WATERMELON | 9 | CHERRY |
| 11 | JACK | CHERRY | JACK | ACE | 10 |
| 12 | ACE | ACE | KING | BONUS | 7 |
| 13 | BELL | QUEEN | HEART | 9 | ACE |
| 14 | KING | 9 | 7 | QUEEN | JACK |
| 15 | QUEEN | KING | 10 | 7 | 9 |
| 16 | HEART | WILD | 7 | CHERRY | KING |
| 17 | JACK | ACE | QUEEN | HEART | JACK |
| 18 | 10 | QUEEN | 10 | ACE | ACE |
| 19 | BONUS | WATERMELON | WILD | KING | BELL |
| 20 | 9 | 10 | QUEEN | WATERMELON | QUEEN |
| 21 | CHERRY | 9 | 10 | 10 | ACE |
| 22 | JACK | QUEEN | CHERRY | BELL | 9 |
| 23 | 10 | CHERRY | ACE | 9 | WATERMELON |
| 24 | WATERMELON | ACE | BONUS | 10 | 10 |
| 25 | JACK | BONUS | QUEEN | CHERRY | ACE |
| 26 | | 7 | BELL | KING | CHERRY |
| 27 | | 10 | 9 | | QUEEN |
| 28 | | BELL | | | ACE |
| 29 | | | | | HEART |
| 30 | | | | | 10 |
| 31 | | | | | BELL |
| 32 | | | | | ACE |
| 33 | | | | | KING |
| 34 | | | | | |

FIG.6

SYMBOL COMBINATION TABLE

| SYMBOL | GRAPHICS | 1 | 2 | 3 | 4 | 5 |
|---|---|---|---|---|---|---|
| WILD | | 0 | 0 | 0 | 0 | 0 |
| 7 | | 0 | 0 | 50 | 300 | 1000 |
| HEART | | 0 | 0 | 35 | 200 | 800 |
| BELL | | 0 | 0 | 30 | 100 | 500 |
| WATERMELON | | 0 | 0 | 20 | 50 | 300 |
| CHERRY | | 0 | 0 | 15 | 35 | 300 |
| ACE | A | 0 | 0 | 10 | 30 | 200 |
| KING | K | 0 | 0 | 10 | 20 | 200 |
| QUEEN | Q | 0 | 0 | 10 | 15 | 100 |
| JACK | J | 0 | 0 | 10 | 15 | 100 |
| TEN | 10 | 0 | 0 | 5 | 15 | 100 |
| NINE | 9 | 0 | 0 | 5 | 10 | 100 |

| SYMBOL | GRAPHICS | 1 | 2 | 3 | 4 | 5 |
|---|---|---|---|---|---|---|
| BONUS | | 0 | 0 | 5FG | 10FG | 20FG |

※BONUS SYMBOL IS SCATTER SYMBOL

INFORMATION PROCESSOR AND RECORDING MEDIUM STORING GAME PROGRAM

CROSS-REFERENCE TO RELATED APPLICATION

This application claims the benefit of Japanese Patent Application No. 2018-190087 filed on Oct. 5, 2018, which application is incorporated herein by reference in its entirety.

FIELD OF THE INVENTION

The present invention relates to an information processor and a recording medium storing a game program.

BACKGROUND OF THE INVENTION

Social games have recently been provided. In such a social game, a game provided from a server (information processor) is played on terminal devices such as smartphones owned by many players, over a communication network.

Among the social games, there is a social game in which various random determinations are performed in response to player's operations of a smartphone and the game progresses based on results of random determination (e.g., awarding of an item, awarding of a payout, and occurrence of an event) (Patent Literature 1 (U.S. Unexamined Patent Publication No. 2017-0200346)). In such a game, the random determinations may be successively executed in response to an operation by a player or the occurrence of an event. Under this circumstance, players who are used to play the game may wish to know a result of random determination early by shortening an effect accompanied with the random determination.

To fulfill the wish, an operation of informing a result of random determination early (acceleration of game progress) may be performed by shortening the time of the effect accompanied with the random determination in response to a predetermined operation or the use of a predetermined item awarded in the game progress.

BRIEF SUMMARY OF THE INVENTION

In the game described above, each time the game progresses (e.g., each time random determination is performed) in each smartphone, the server performs data communication with the smartphone to store the information indicating the progress of the game. As such, data communication is performed between the server and each smartphone each time the game progresses. On this account, even when the communication is interrupted or the game freezes, the game progress can be resumed from where the interruption of the communication occurred, thanks to the communication with the server.

Under this circumstance, when the above-described acceleration of game progress is employed, the number of times of data communication per unit time between the server and each smartphone increases. As a result, when many players choose the acceleration of game progress, the game progress may be delayed or the server may be down on account of access concentration to the server.

To solve this problem, the present disclosure provides an information processor and a recording medium storing a game program, with which access concentration to the information processor is suppressed even when acceleration of game progress is performed in a game which requires data communication between the information processor and a terminal device.

The present invention relates to an information processor which provides a game in which a benefit is awarded as a result of random determination to a terminal device over a communication line, and includes:

a storage unit configured to store a result of the random determination for each terminal device; and a controller which is programmed to execute the processes of:

(a) receiving, from the terminal device, a result of the random determination of determining content of the benefit, which is sent each time the random determination is executed;

(b) storing, in the storage unit, the result of the random determination received in the process (a);

(c) when a game acceleration instruction for accelerating progress of the game is made in the terminal device, receiving results of a predetermined number of times of execution of the random determination, which are sent together from the terminal device; and (d) storing, in the storage unit, the results of the predetermined number of times of execution of the random determination, which are received in the process (c).

According to the arrangement above, the information processor typically receives, from each terminal device, a result of random determination for determining the content of the benefit, each time the random determination is executed, and stores the progress of the game based on the result of the random determination in the storage unit. Meanwhile, when the game acceleration instruction for accelerating the progress of the game is made in the terminal device by a predetermined operation or by the use of a predetermined item awarded in the game progress, results of a predetermined number of times of execution of random determination, which are sent together from each terminal device, are received together, and the state of progress of the game based on the result of the predetermined number of times of execution of random determination is stored in the storage unit.

As such, even when the progress speed of the game is accelerated, the number of times of data communication per unit time between the information processor and each terminal device is suppressed, with the result that access concentration to the information processor is suppressed.

According to the present invention, the above-described information processor is arranged such that, in the terminal device, an item for accelerating the game is awarded when a predetermined condition is satisfied, and the game acceleration instruction is made when the item for accelerating the game is used.

In the progress of the game, when an item for accelerating the game, which is awarded if the predetermined condition is satisfied during the progress of the game, is used, the progress of the game is accelerated. On this account, even when a function in which the progress speed of the game is accelerated and the number of times of data communication per unit time between the information processor and each terminal device is increased is employed, it is possible to restrict the valid time of this function (i.e., the time from the use of the item to the expiry of the effect of the item), with the result that access concentration to the information processor suppressed.

The present invention relates to a non-volatile recording medium storing a game program which is executed between a terminal device and an information processor over a communication line, when a game in which a benefit is awarded as a result of random determination is executed, the game program causing:

(a) the terminal device to send a result of the random determination for determining content of the benefit to the information processor, each time the random determination is executed;

(b) the information processor to store the result of the random determination received in (a) in a storage unit;

(c) the terminal device to send results of a predetermined number of times of execution of the random determination together to the information processor, when a game acceleration instruction is made to accelerate the progress of the game; and (d) the information processor to store, in the storage unit, the results of the predetermined number of times of execution of the random determination, which are received in (c).

According to the arrangement above, even when the progress speed of the game is accelerated, the number of times of data communication per unit time between the information processor and each terminal device is suppressed, with the result that access concentration to the information processor is suppressed.

An information processor, etc., with which access concentration to the information processor is suppressed even when acceleration of game progress is performed in a game which requires data communication between the information processor and a terminal device, can be provided.

BRIEF DESCRIPTION OF THE DRAWINGS

FIG. 5 illustrates a symbol arrangement on video reels in the slot game.

FIG. 6 illustrates a symbol combination table of the slot game.

DETAILED DESCRIPTION OF THE PREFERRED EMBODIMENT

Embodiment

An information processor of the present embodiment will be described with reference to figures.

Figure 1:
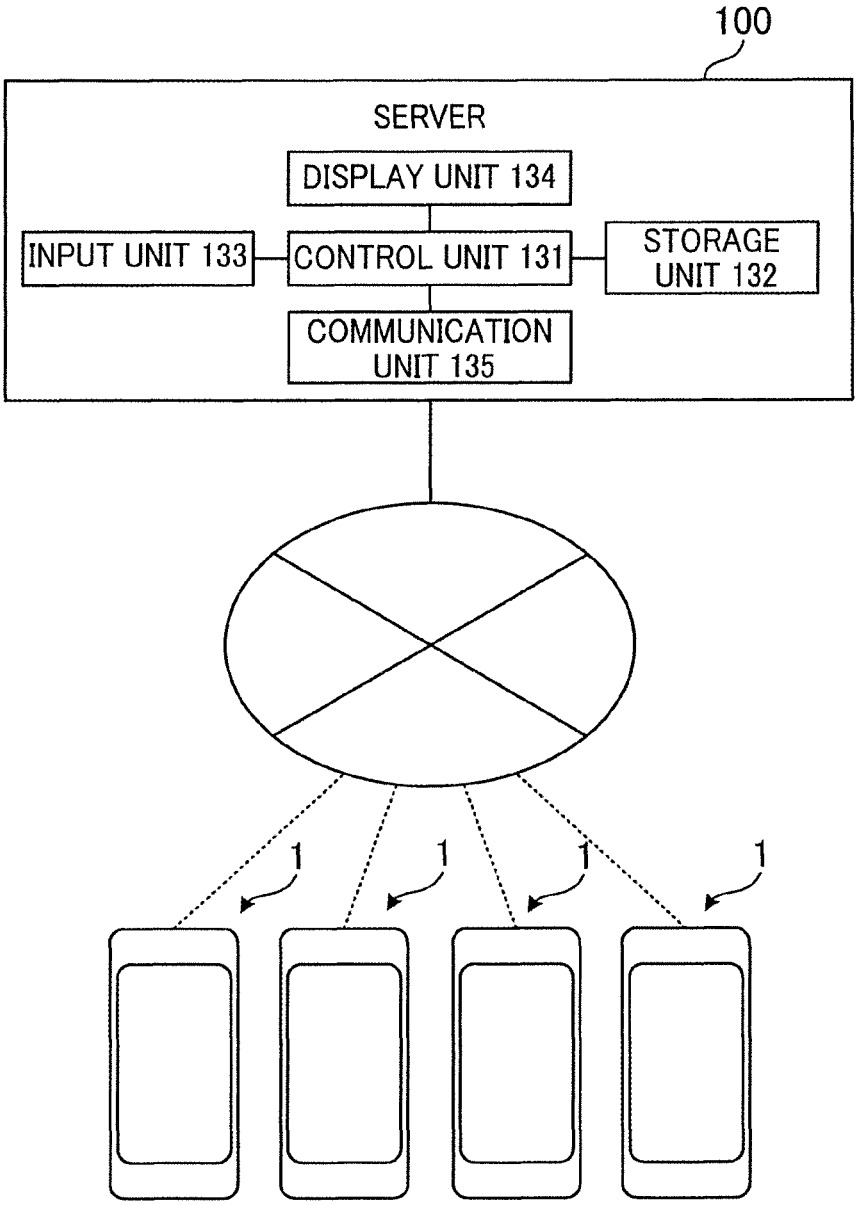
FIG. 1 illustrates a network environment between a server and a smartphone.

As shown in FIG. 1, a slot game (unit game) of the present embodiment is embodied as a social game which is executed through exchange of game data between a server 100 (information processor) and each smartphone 1 (terminal device), etc. over the Internet (communication line). To be more specific, game software of the slot game is run on a web browser provided by the server 100. As a result of player's access to the web browser provided by the server 100 through a terminal device such as a smartphone 1 and a PC, the slot game is run.

Figure 2:
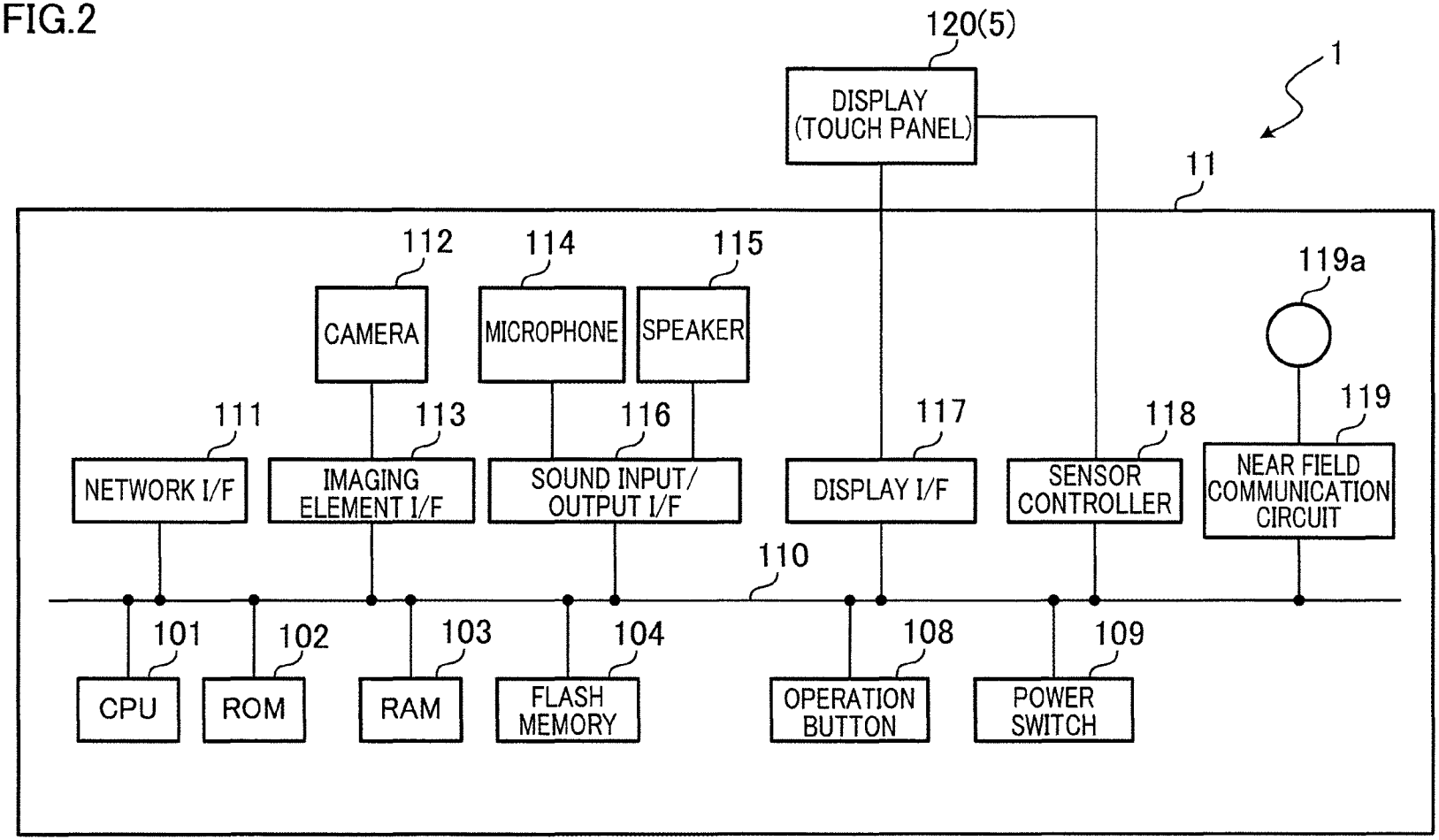
FIG. 2 is a block diagram of the electrical configuration of the smartphone.

In the present embodiment, the server 100 shown in FIG. 1 is taken as an example of the information processor, and the smartphone 1 shown in FIG. 2 is taken as an example of the terminal device. The processes and actions of the server 100 and the smartphone 1 can be interpreted as those of a program, a game control method, or a system realized between the server 100 and the smartphone 1.

(Online)

The slot game of the present embodiment is run as an online game. To be more specific, as shown in FIG. 1, the server 100 managed by an administration organization of the slot game is connected to smartphones 1 of many players over the Internet.

In this way, the slot game is run online. As a result of player's access to the web browser provided by the server 100 through an information device such as a smartphone 1 and a PC, the slot game can be run. The server 100 is configured to exchange credits (which can be bought by cash, a credit card, electronic money, a prepaid card, etc.) owned by players to coins (gaming media) which are electronic information usable in the slot game, and to manage the coins owned by the players.

(Structure of Server 100)

As shown in FIG. 1, the server 100 is an information processor which is used by an administrator of the slot game, etc. to manage and control a social game service. As the server 100 receives a request or game data from a smartphone 1 operated by a player, the server 100 sends a game program, a web browser, game data, etc. which can be run on the smartphone 1. The server 100 of the present embodiment includes a control unit 131, a storage unit 132, an input unit 133, a display unit 134, and a communication unit 135.

The control unit 131 (e.g., a CPU) is configured to control the server 100. Furthermore, data is sent and received between the control unit 131, the storage unit 132, the input unit 133, the display unit 134, and the communication unit 135.

The storage unit 132 is constituted by a ROM (Read Only Memory) storing a system program, a RAM (Random Access Memory) which is a rewritable storage area, a flash memory, etc.

The input unit 133 is a device allowing the administrator or the like to input setting or the like of the slot game, and is embodied by a keyboard and a mouse, for example.

The display unit 134 is configured to display an operation screen for the administrator, in response to an instruction from the control unit 131.

The communication unit 135 is provided to communicate with the smartphones 1.

(Structure of Smartphone 1)

As shown in FIG. 2, the smartphone 1 includes, in a housing 11, a CPU 101 (controller), a ROM 102, a RAM 103, a flash memory 104, an operation button 108, a power switch 109, a bus line 110, a network I/F 111, a camera 112, an imaging element I/F 113, a microphone 114, a speaker 115, a sound input/output I/F 116, a display I/F 117, a sensor controller 118, a near field communication circuit 119, and an antenna 119*a* of the near field communication circuit 119. In the front surface of the housing 11, a display 120 with a touch panel 5 (input unit) is embedded.

The display 120 is configured to be able to display images. The display method of the display 120 is, for example, liquid crystal, organic electroluminescence, CRT (Cathode Ray Tube), and plasma.

The CPU (Central Processing Unit) 101 controls the entire smartphone 1. The ROM (Read Only Memory) 102 stores programs used for driving the CPU 101, such as an IPL (Initial Program Loader).

The RAM (Random Access Memory) 103 is used as a work area of the CPU 101. The flash memory 104 stores application software (program) for running the game of the present embodiment, a communication program, and data such as image data and sound data. The operation button 108 is used for, for example, initial setting of the smartphone 1. The power switch 109 is used for turning on/off the power source of the smartphone 1.

The network I/F (Interface) 111 is an interface for performing data communication with the server 100, etc., by utilizing a communication network such as the Internet. The camera 112 is a built-in camera image capturing means which captures an image of an object to obtain image data under the control of the CPU 101. The imaging element I/F 113 is a circuit for controlling the camera 112. The microphone 114 is a built-in sound collection means to which sound is input. The sound input/output I/F 116 is a circuit for processing input and output of a sound signal between the microphone 114 and the speaker 115 under the control of the CPU 101. The display I/F 117 is a circuit for sending image data to the display 120 under the control of the CPU 101. The sensor controller 118 is a circuit for receiving an input from the touch panel 5 of the display 120. The near field communication circuit 119 is a communication circuit based on NFC (Near Field Communication) (Registered Trademark). Bluetooth (Registered Trademark), or the like. The bus line 110 is an address bus, a data bus, or the like for electrically connecting the components such as the CPU 101.

(Outline of Slot Game Executed by Server 100)

Figure 3:
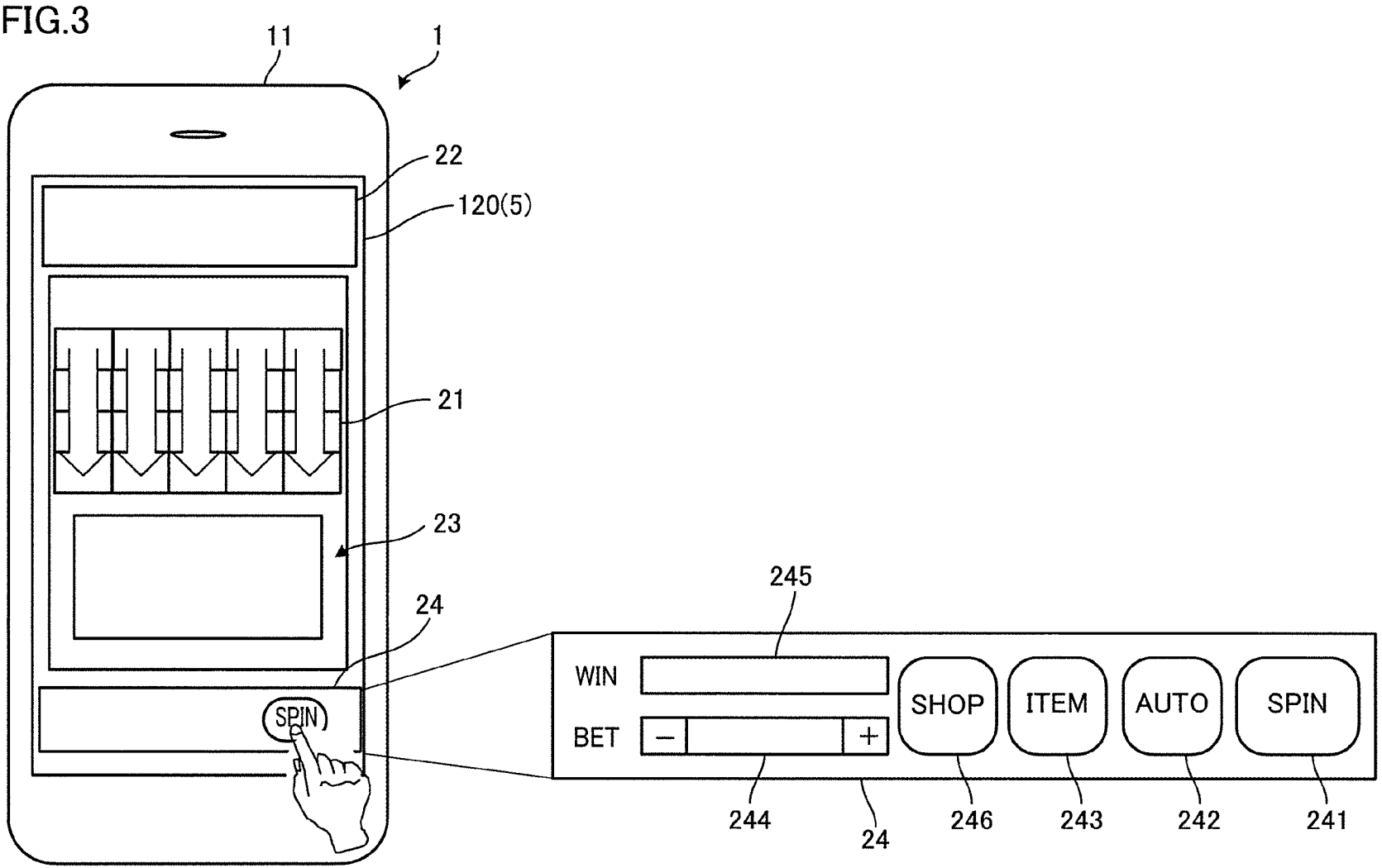
FIG. 3 shows a display state of a slot game on the smartphone.

When a request is sent from the smartphone 1 to the server 100, effect images, videos, etc. of the slot game are displayed by a web browser on the display 120 of the smartphone 1. Thereafter, the slot game starts upon selection of a selection image indicating the start of the slot game on the touch panel 5 (detailed later). For example, as shown in FIG. 3, when the slot game starts, the slot game in which symbols are rearranged in a symbol display area 21 which is formed of 20 areas forming a matrix with 5 columns and 4 rows becomes executable.

Plural types of slot games may be executable, and the rule, the state of payout, and effect images may be different depending on which slot game is executed. For example, in a slot game of one type, symbols are rearranged in a symbol display area formed of 9 areas forming a matrix with 3 columns and 3 rows. In this slot game, whether a win is achieved is determined based on a combination of symbols rearranged on a payline set only at the middle stage of the symbol display area (winning determination).

The slot game of the present embodiment is basically started in response to the consumption of a predetermined amount of coins (gaming media) owned by a player. When a predetermined condition is satisfied, the player is able to start the slot game without the consumption of coins. (The predetermined condition is, for example, a condition of awarding a free game or the slot game is playable without the consumption of coins for a predetermined number of times in a day.)

The coins owned by players are electronic information. A player accesses the server 100 via the smartphone 1 and exchanges credits to coins in accordance with a payment method specified by the management organization of the slot game. The coins owned by players are used in various ways. For example, the coins are consumed to obtain an effect influencing on the slot game (as purchase of items), or consumed to change the appearance of an avatar of a player.

The number of coins owned by each player, which is managed by the server 100, is shared between the server 100 and each smartphone 1.

The gaming medium is not limited to any particular type, and may be electronic money or a game point not including valuable information.

(Slot Game: Definitions)

As shown in FIG. 3, the slot game executed in the present embodiment is a game in which symbols are varied in the symbol display area 21 (scrolling image of reels) and then stopped (rearranged), and a benefit (e.g., a payout or an item advantageous or disadvantageous for the player) is awarded based on the combination of the symbols displayed in the symbol display area 21. A state in which symbols are displayed after being varied and stopped in the symbol display area 21 is termed "rearrangement".

A payout awarded based on a combination of symbols displayed in the symbol display area 21 is awarding of coins.

The "unit game" is a series of operations from the start of the receiving of a bet to the establishment of a prize (i.e., a combination of symbols satisfies a predetermined relation). To put it differently, the unit game includes a single bet time for receiving a bet, a single game time of rearranging stopped symbols, and a single payout time of a payout process of awarding a payout.

(Slot Game Screen)

A slot game screen displayed on the display 120 of the smartphone 1 will be described.

As shown in FIG. 3, when the slot game is executed, the slot game screen is displayed on the display 120. The slot game screen displays the symbol display area 21 formed of 20 areas forming a matrix with 5 columns and 4 rows, a game information display area 22 on which information of increment and decrement in accordance with the execution of the slot game (e.g., the number of currently-owned coins) is displayed, an effect display area 23 on which moving and still images and messages related to the game are displayed in accordance with the progress of the slot game, and an operation display area 24 which is operated by the player to progress the slot game. The operation display area 24 includes a spin button 241, an AUTO button 242, an ITEM button 243, a bet button 244, a WIN display portion 245, and a shop button 246.

On the entire surface of the display 120, a touch panel 5 which allows the slot game screen to be viewable from the outside is provided. The touch panel 5 makes it possible to detect the coordinates of a part touched by a player's finger or the like. With this arrangement, for example, the slot game (unit game) is executed once, upon a touch input of the image of the spin button 241. Furthermore, the slot game is serially executed plural times as the image of the AUTO button 242 is pressed. When the image of the ITEM button 243 is pressed, the player is able to select and use a previously-obtained item (which exerts an influence in the slot game). When the image of the shop button 246 is touched, the smartphone 1 accesses the server 100 and the player enters a shop in which credits (which can be bought by cash, a credit card, electronic money, a prepaid card, etc. owned by the player) are exchangeable with coins, or credits or coins are exchangeable with an item.

(Paylines)

In the symbol display area 21, five video reels on which symbols are provided (see FIG. 5) are scrolled, and are stopped after a predetermined time elapses. As a result, parts of each video reel (four successive symbols in the present embodiment) are displayed for the player. In the symbol display area 21, one symbol is displayed in each of the four areas in the upper stage, the upper middle stage, the lower middle stage, and the lower stage, in each video reel. To put it differently, 20 symbols forming a matrix with 5 columns and 4 rows are displayed in the symbol display area 21.

Figure 4:
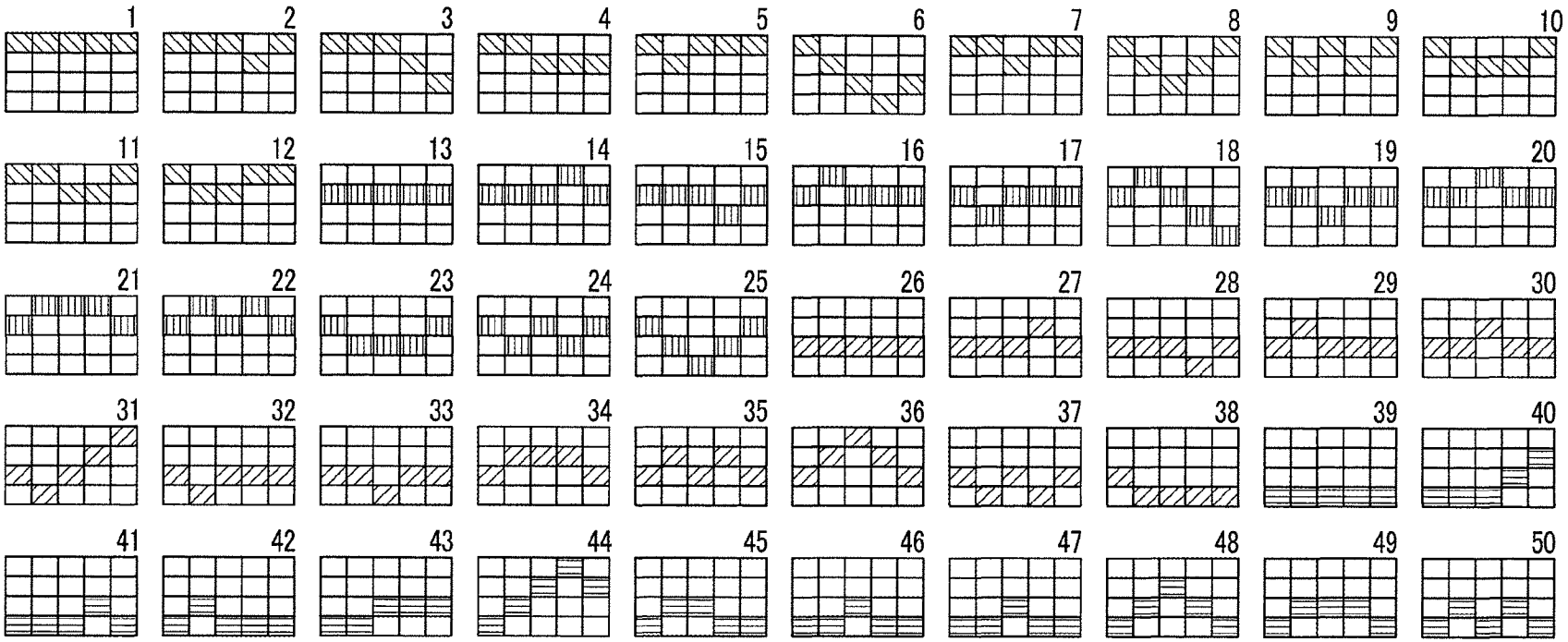
FIG. 4 shows paylines of the slot game.

In the present embodiment, one of four stages, i.e., the upper stage, the upper middle stage, the lower middle stage, and the lower stage, is selected in each of the video reels, and a line connecting the selected stages is used as a payline (see FIG. 4). When three or more symbols of the same type successively stop on the payline, a win is achieved (a payout is awarded) (see FIG. 6). In regard to the number of the paylines, while there are 50 paylines in the present embodiment as shown in FIG. 5, the number of the paylines may be 30, for example.

(Symbol Arrays of Video Reels)

Now, with reference to FIG. 5, the following describes a configuration of the symbol arrays on the video reels of the slot game.

As shown in FIG. 5, to each of "REEL1", "REEL2", "REEL3", "REEL4", and "REEL5" of the video reels 3, a symbol array formed of symbols corresponding to code numbers 0 to 33 is allocated. The types of the symbols arranged on the symbol arrays of the video reels include normal symbols such as "7", "HEART", "BELL", "WATERMELON", "CHERRY", "ACE", "KING", "QUEEN", "JACK", "10", and "9", a "BONUS" symbol with which BONUS triggering the awarding of a free game is won, and a "WILD" symbol which is an almighty symbol that can substitute for any other symbol. The "BONUS" symbol is a scatter symbol, and a win is achieved based on the number of "BONUS" symbols stopped in the symbol display area 21, irrespective of payline.

(Symbol Combination Table)

Now, a symbol combination table will be described with reference to FIG. 6. FIG. 6 shows a symbol combination table used in the slot game of the present embodiment.

The symbol combination table of the slot game defines the combinations of symbols (the number of symbols) with which a win is achieved and payout amounts of coins paid out (payout). In the slot game, scroll of five video reels is stopped, and a win is achieved when three or more symbols of the same type successively stop on a payline which is a target of result determination, in the symbol display area 21 (see FIG. 6). In accordance with the type of win, a benefit will be given to the player in the form of awarding a payout and the like.

[Contents of Program]

The program of the slot game executed between the smartphone 1 and the server 100 will be described with reference to FIG. 7 to FIG. 11.

(Normal Slot Game Control Process)

Figure 7:
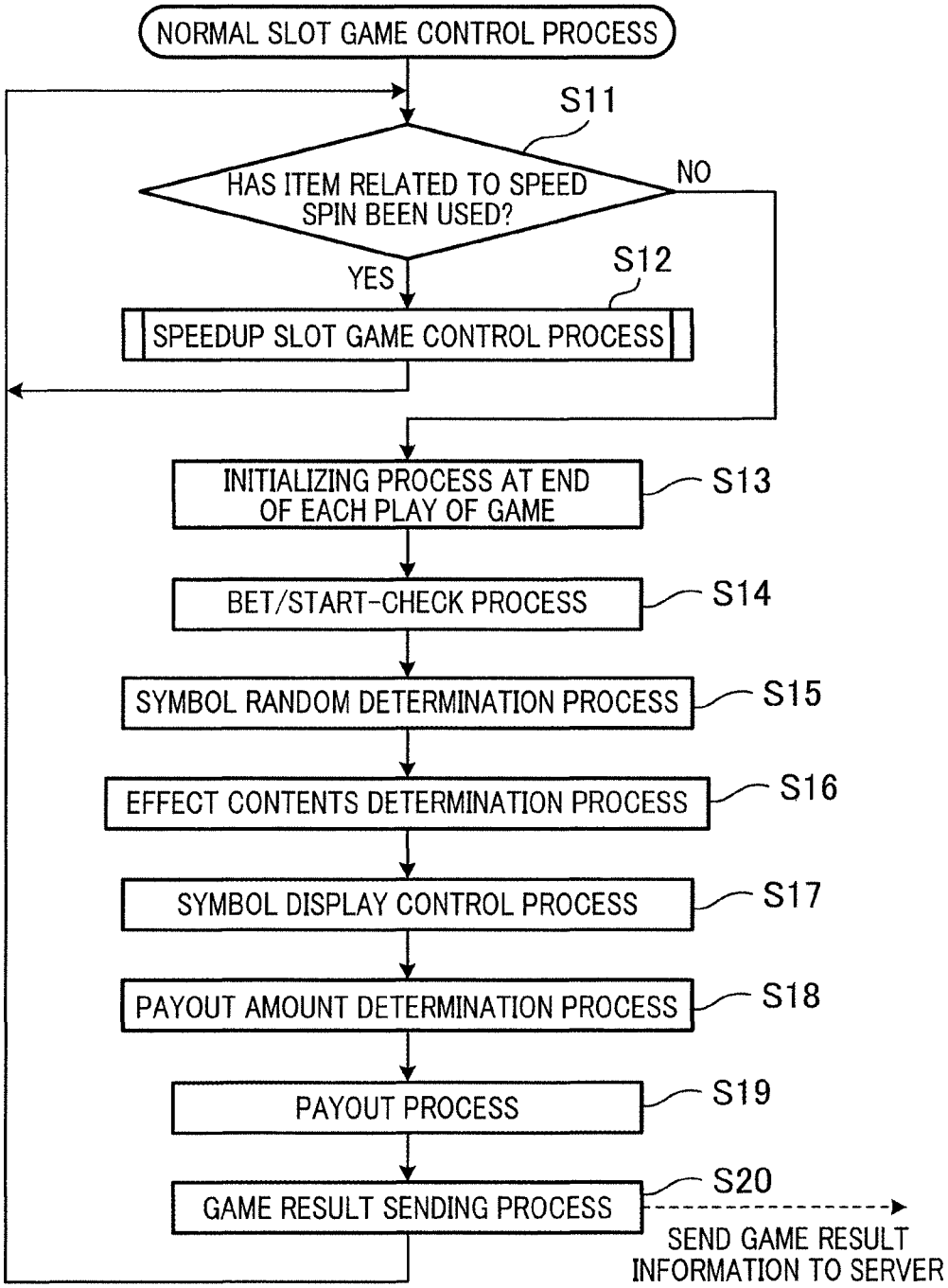
FIG. 7 shows a flowchart of a normal slot game control process.

The normal slot game control process executed by the smartphone 1 will be described with reference to FIG. 7.

To begin with, before the start of the slot game, the CPU 101 checks if a "Speed Spin" item or a "High Speed Spin" item has been used (i.e., checks if an item related to speed spin has been used) (S11). When the "Speed Spin" item or the "High Speed Spin" item has been used (YES in S11), the routine shifts to a speedup slot game control process (S12). The speedup slot game control process (S12) will be detailed later. After S12, the routine goes back to S11. The use of the "Speed Spin" item or the "High Speed Spin" item is equivalent to the dispatchment of a game acceleration instruction.

How items such as the "Speed Spin" item and the "High Speed Spin" item are obtained in the slot game of the present embodiment will be described. In the slot game of the present embodiment, various items can be obtained in the advancement of the slot game, as a benefit awarded as a result of the slot game, or in exchange for coins in a shop. For example, after the end of the unit game in the slot game, the player is allowed to touch an image of a shop button 246 in the operation display area 24 shown in FIG. 3 to display a shop window in which exchange to various items can be done. In the shop window, icons each associated with the number of coins required to exchange for an item are displayed. The player is allowed to select any of the displayed icons to exchange the owned coins for a desired item.

Figure 10:
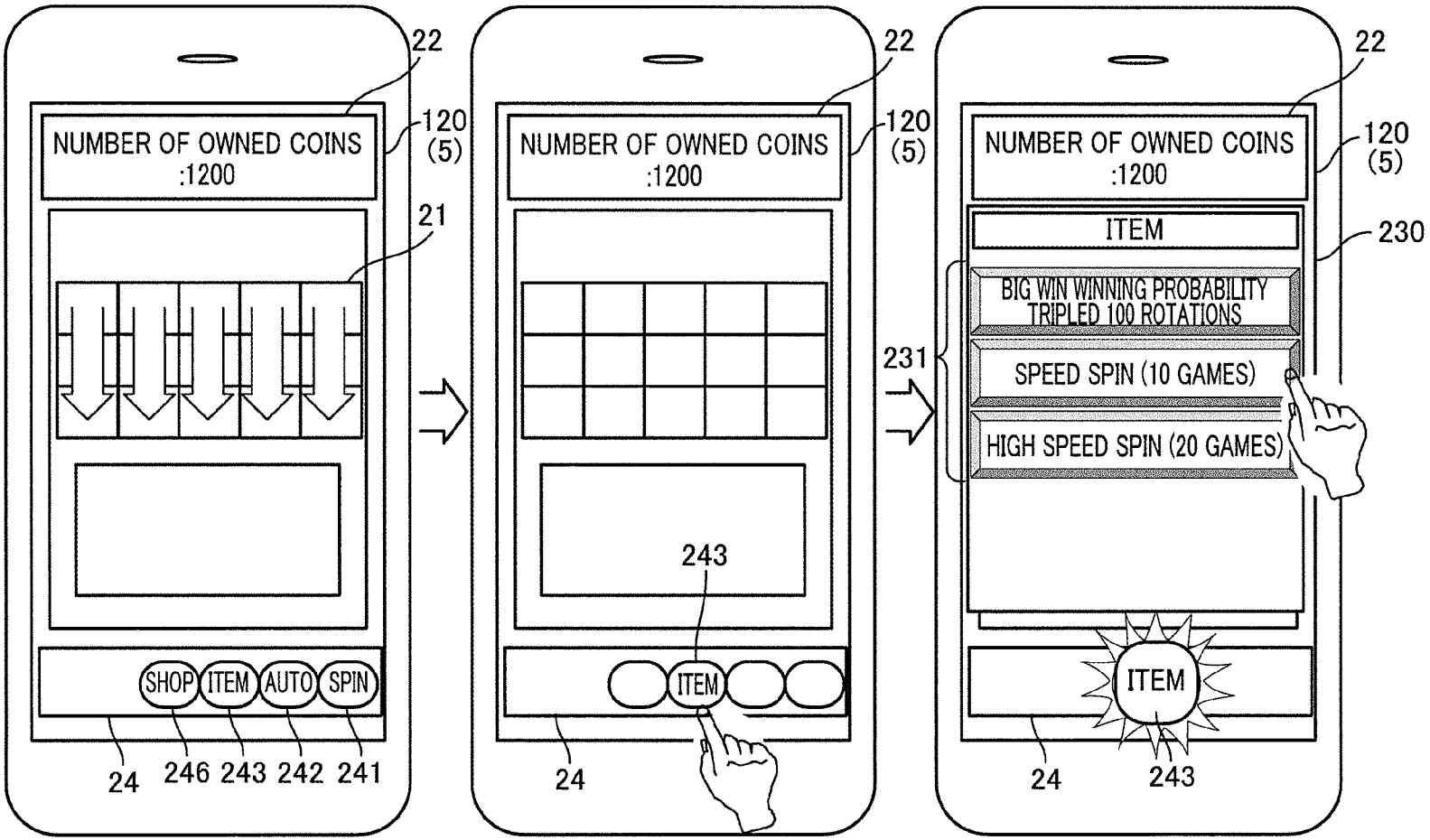
FIG. 10 illustrates a display screen of the slot game displayed on the smartphone.

The following will briefly describe how items obtained in the progress of the slot game, etc., are used. In the present embodiment, for example, as shown in FIG. 10, after the end of the unit game in the slot game, etc., the player is allowed to touch an image of an ITEM button 243 in the operation display area 24 to display an item window 230 in which items owned by the player are displayed for selection. In the item window 230, as shown in FIG. 10, item icons 231 owned by the player are displayed. The player is allowed to select any of the displayed item icons 231 to be used. For example, as shown in FIG. 10, when the item icon 231 corresponding to "Speed Spin (10 Games)" is selected from the item icons 231, an effect of the use of the item "Speed Spin (10 Games)" is exerted.

In the present embodiment, in later-described steps S13 to S20 of the normal slot game control process, on the display 120 of the smartphone 1, five video reels scroll after the spin button 241 is touched. After a predetermined time elapses, the video reels stop one by one in the respective arrays of the symbol display area 21, from REEL1 to REEL5. Thereafter, with reference to a combination of symbols stopped in the symbol display area 21 and a symbol combination table in FIG. 6, an effect of determining whether a win is achieved and effect display of displaying a payout amount when a win is achieved are carried out. Then effect display such as "GREAT" and "CONGRATULATIONS" is further performed depending on the type of win. With the progress speed of the slot game in the steps S13 to S20, a certain amount of time is required to finish the unit game because effects are displayed. On this account, when the "Speed Spin (10 Games)" item is used, the routine shifts to the speedup slot game control process (S12), and the progress speed of the slot game is quadrupled in the subsequent 10 executions of the unit game. When the "High Speed Spin (20 Games)" item is used, the routine shifts to the speedup slot game control process (S12), and the progress speed of the slot game is accelerated 8 times in the subsequent 20 executions of the unit game.

The progress speed of the slot game corresponding to an item related to speed up such as the "Speed Spin" item and the "High Speed Spin" item can be set at will by the administrator of the slot game. While in the present embodiment a period in which the progress speed of the slot game is increased corresponds to the number of times of execution of the unit game, the period may be defined by time. For example, when a "Speed Spin (10 Minutes)" item is used, the progress speed of the subsequent slot game is quadrupled for 10 minutes. When a "High Speed Spin (20 Minutes)" item is used, the progress speed of the subsequent slot game is accelerated 8 times for 20 minutes. The way of acquisition, the way of use, and the effects of the items related to speed up such as the "Speed Spin" item and the "High Speed Spin" item have been described.

Meanwhile, in S11, when the "Speed Spin" item or the "High Speed Spin" item has not been used (NO in S11), the CPU 101 executes an initializing process at the end of each play of the game, in order to start the slot game (S13). For example, this process clears data in a working area of the RAM 103, which becomes unnecessary at the end of each play of the unit game, e.g., a payline activated in the previous execution of the unit game, the value of a bet counter in a bet amount storage area, and symbols to be displayed on the symbol display area 21 as a result of random determination.

The CPU 101 then executes a bet/start-check process (S14). In this bet/start check process, which payline is activated is determined (see FIG. 4). By a touch input such as pressing of a "+" button and a "−" button (see FIG. 3) of the bet button 244 of the operation display area 24 of the display 120 of the smartphone 1, the number of coins betted on the payline activated by the player is determined. The number of coins betted on the activated payline is stored in a bet amount counter of the RAM 103. The number of coins betted on the activated payline is determined in this way. As a result, when a win is achieved in the slot game, a payout awarded for the win equals to a value calculated by multiplying a payout corresponding to the win achieved on the activated payline (see FIG. 6) by the number of betted coins. In the bet/start-check process, furthermore, the CPU 101 determines whether a touch input has been made to the spin button 241. When a touch input has been made to the spin button 241, the routine proceeds to S15 and the slot game progresses.

Subsequently, the CPU 101 executes a symbol random determination process (S15). In this process, by using the video reels shown in FIG. 5, to-be-stopped symbols are randomly selected from symbols provided on the video reels (REEL1, REEL2, REEL5, REEL4, and REEL5). The to-be-stopped symbols are data of five symbols to be displayed in the lower middle stage of each column of the symbol display area 21, out of the symbols forming each video reel. In this way, 20 symbols displayed in the symbol display area 21 are determined.

For example, in case of REEL1 of the video reels, when a code number "22" is randomly selected from 26 symbols (code numbers "0" to "25"), the "JACK" symbol corresponding to the code number "22" is selected as the to-be-stopped symbol. In case of the REEL2, when a code number "11" is randomly selected from 29 symbols (code numbers "0" to "28"), the "CHERRY" symbol corresponding to the code number "11" is selected as the to-be-stopped symbol. In case of the REEL3, when a code number "9" is randomly selected from 28 symbols (code numbers "0" to "27"), the "10" symbol corresponding to the code number "9" is selected as the to-be-stopped symbol. In case of the REEL4, when a code number "8" is randomly selected from 27 symbols (code numbers "0" to "26"), the "10" symbol corresponding to the code number "8" is selected as the to-be-stopped symbol. In case of the REEL5, when a code number "7" is randomly selected from 34 symbols (code numbers "0" to "33"), the "HEART" symbol corresponding to the code number "7" is selected as the to-be-stopped symbol.

The CPU 101 then stores the determined five to-be-stopped symbols in a symbol storing area in the RAM 103.

Subsequently, the CPU 101 executes an effect contents determination process (S16). The CPU 101 samples an effect-use random number and randomly selects any of a plurality of predetermined effect contents.

Figure 11:
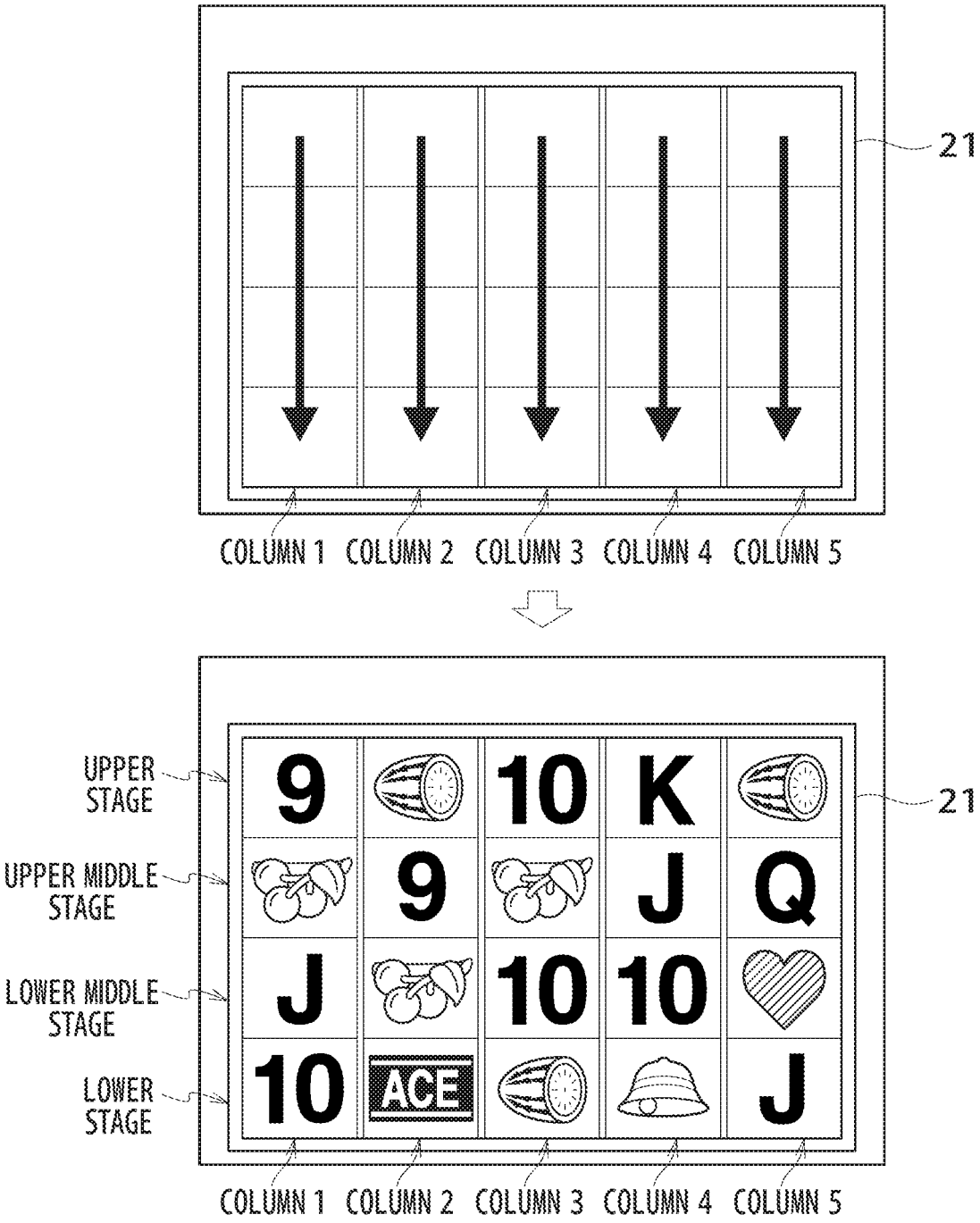
FIG. 11 illustrates a display screen of the slot game displayed on the smartphone.

Then, the CPU 101 executes a symbol display control process (S17). In this symbol display control process, as shown in FIG. 11, the scroll of the symbol arrays (REEL1, REEL2, REEL3, REEL4, and REEL5) of the video reels starts. After a predetermined time elapses, the five to-be-stopped symbols selected in the symbol random determination process in S15 are rearranged one by one in the lower middle stages of the column 1 to the column 5 of the symbol display area 21. In other words, 20 symbols including the to-be-stopped symbols are rearranged in the symbol display area 21. For example, as described above, when the "JACK" symbol is selected as a to-be-stopped symbol in the REEL1, the "CHERRY" symbol is selected as a to-be-stopped symbol in the REEL2, the "10" symbol is selected as a to-be-stopped symbol in the REEL3, the "10" symbol is selected as a to-be-stopped symbol in the REEL4, and the "HEART" symbol is selected as a to-be-stopped symbol in the REEL5, the symbols "JACK", "CHERRY", "10", "10", and "HEART" are provided in the lower middle stages of the column 1 to the column 5 of the symbol display area 21. In the upper, upper middle, and lower stages of each of the column 1 to the column 5 of the symbol display area 21, symbols having code numbers each of which is one number off the to-be-stopped symbols are rearranged (see FIG. 11).

Subsequently, the CPU 101 executes a payout amount determination process (S18). In this process, whether three or more symbols of the same type successively stop on the activated payline and a win is achieved is determined based on the symbol combination table for the slot game (see FIG. 6), which is stored in the RAM 103. In accordance with the type of win, a benefit will be given in the form of awarding a payout and the like. The payout awarded is stored in a payout amount storage area which is provided in the RAM 103.

For example, when the "7" symbol stops at row 1, column 1, the "7" symbol stops at row 1, column 2, the "7" symbol stops at row 1, column 3, and the "CHERRY" symbol stops at row 1, column 4 on a payline 1 (see FIG. 4) as shown in FIG. 13, a win with 3Kinds of "7" is achieved. For the 3Kinds of "7", the symbol combination table shown in FIG. 6 is referred to, and a payout is determined as "50" coins (when the bet amount is 1) and this payout amount is stored in the payout amount storage area in the RAM 103.

In the payout amount determination process, whether a win with "BONUS" (3Kinds of "BONUS", 4Kinds of "BONUS", or 5Kinds of "BONUS") is established is further determined. When the "BONUS" win is achieved, the free game is executed. This free game allows the player to play the slot game the number of times corresponding to the established "BONUS" win, without the consumption of coins. For example, in the case of the 3Kinds of "BONUS", the free game can be played five times (see FIG. 6).

Subsequently, the CPU 101 executes a payout process (S19). The CPU 101 adds a value stored in the payout amount storage area of the RAM 103 to the value of the coin counter provided in the RAM 103. For example, when "50" is stored in the payout amount storage area in the payout amount determination process in S18, "50" is added to the value of the coin counter.

The CPU 101 then executes a game result sending process (S20). In this game result sending process, results of the execution of the slot game once (unit game) are sent to the server 100 as game result information (equivalent to a result of random determination in the present invention). The results are, for example, the number of coins betted in S14 (the value of the bet counter in the RAM 103), the to-be-stopped symbols determined in the normal symbol random determination process in S15 (i.e., 20 symbols displayed in the symbol display area 21), the type of a win achieved in the payout amount determination process in S18 (including a failure), and the value of the coin counter updated in the payout process (i.e., the number of coins owned). After S20, the routine goes back to S11.

(Speedup Slot Game Control Process)

Figure 8:
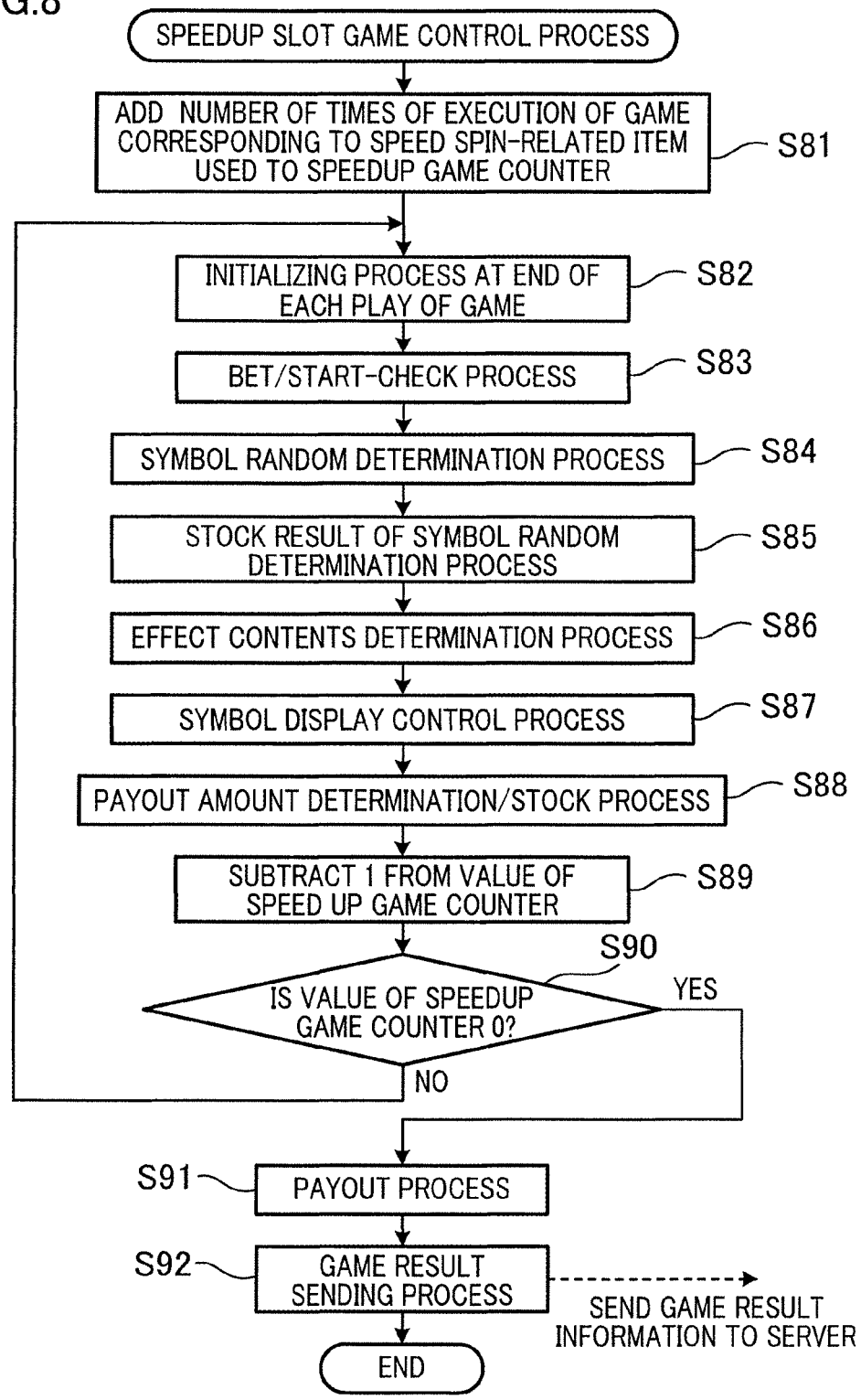
FIG. 8 shows a flowchart of a speedup slot game control process.

Referring to FIG. 8, a speedup slot game control process will be described. This speedup slot game control process is executed when, in S11 of the above-described normal slot game control process, it is determined that the "Speed Spin" item or the "High Speed Spin" item has been used (YES in S11).

To begin with, the CPU 101 adds the number of plays of the game corresponding to the speed spin-related item having been used to a speedup game counter of the RAM 103 (S81). For example, when the "Speed Spin (10 Games)" item has been used, "10" is added to the speedup game counter of the RAM 103. When the "High Speed Spin (20 Games)" item has been used, "20" is added to the speedup game counter of the RAM 103.

Subsequently, in the same manner as in S13, the CPU 101 executes an initializing process at the end of each play of the game, in order to start the slot game (S82).

The CPU 101 then executes a bet/start-check process in the same manner as in S14 (S83). The number of coins betted in S83 (the value of the bet counter of the RAM 103) is stored as a set of game result information in a stock area of the RAM 103. (The game result information stocked in the stock area is not initialized in S82.)

Subsequently, the CPU 101 executes a symbol random determination process as in S17 (S84). In this step, by using the video reels shown in FIG. 5, five symbols are randomly selected as to-be-stopped symbols displayed in the lower middle stages of the respective arrays of the symbol display area 21. The CPU 101 then stores the five to-be-stopped symbols determined in S84 in a symbol storing area of the RAM 103.

In addition to the above, the CPU 101 stocks the five to-be-stopped symbols selected in the symbol random determination process in S84 (S85). To be more specific, the CPU 101 stores the five to-be-stopped symbols determined in S84 in the stock area of the RAM 103 as a set of game result information. While the steps S82 to S90 are repeated, the five to-be-stopped symbols selected in the symbol random determination process in S84 are stored in the stock area of the RAM 103 as a set of game result information, with information indicating in which cycle the symbols are selected. For example, when the "Speed Spin (10 Games)" item has been used and the value of the speedup game counter in the RAM 103 is "10", because the steps S82 to S90 are repeated 10 times, the five to-be-stopped symbols are numbered such as "five to-be-stopped symbols of the first cycle", "five to-be-stopped symbols of the second cycle", . . . , and "five to-be-stopped symbols of the tenth cycle", and are stored in the stock area of the RAM 103 as game result information.

Subsequently, the CPU 101 executes an effect contents determination process as in S16 (S86). The CPU 101 samples an effect-use random number and randomly selects any of a plurality of predetermined effect contents.

The CPU 101 then executes a symbol display control process based on the five to-be-stopped symbols stored in the symbol storing area (S87). In this symbol display control process, as shown in FIG. 11, the scroll of the symbol arrays (REEL1, REEL2, REEL3, REEL4, and REEL5) of the video reels starts. After a predetermined time elapses, the to-be-stopped symbols (five to-be-stopped symbols) selected in the process in S84 are rearranged one by one in the lower middle stages of the column 1 to the column 5 of the symbol display area 21. In other words, 20 symbols including the to-be-stopped symbols are rearranged in the symbol display area 21.

Subsequently, the CPU 101 executes a payout amount determination/stock process (S88). In this payout amount determination/stock process, whether predetermined symbols stop in combination on an activated payline and a win is achieved is determined based on 20 symbols rearranged in the symbol display area 21 and a symbol combination table for the slot game (see FIG. 6) stored in the RAM 103. In accordance with the type of win, a benefit will be given in the form of awarding a payout and the like. The payout awarded, etc., is stored in the stock area which is provided in the RAM 103.

As described above, when the "Speed Spin" item is used in the speedup slot game control process, the speed of the progress of the slot game including effects displayed on the display 120 of the smartphone 1 is quadrupled in the steps S84 to S88. The effects in the slot game include an effect in which five video reels scroll and, after a predetermined time elapses, stop in order in the arrays of the symbol display area 21 from the REEL1 to the REEL5, an effect of determining whether a win is achieved with reference to a combination of symbols stopped in the symbol display area 21 and the symbol combination table shown in FIG. 6, an effect of displaying a payout amount when a win is achieved, and an effect of displaying texts such as "GREAT" and "CONGRATULATIONS" in accordance with the type of win. When the "High Speed Spin" item is used, the progress speed of the slot game including the above-described effects is accelerated 8 times.

Subsequently, the CPU 101 subtracts "1" from the value of the speedup game counter of the RAM 103 (S89).

Subsequently, the CPU 101 determines whether the value of the speedup game counter of the RAM 103 is 0 (S90). When the value of the speedup game counter is not 0 (NO in S90), the process goes back to S82.

Meanwhile, when the value of the speedup game counter is 0 in S90 (YES in S90), the CPU 101 executes a payout process (S91). In this payout process, the CPU 101 adds the total payout amount awarded in S88 and stored in the stock area of the RAM 103 to the value of the coin counter provided in the RAM 103.

The CPU 101 then executes a game result sending process (S92). In this game result sending process, sets of game result information stored in the stock area of the RAM 103 are sent to the server 100 together. To be more specific, results of the slot game obtained in the repeated execution of S82 to S90, such as the number of coins betted in S83, the five to-be-stopped symbols determined in S84, and a payout awarded in S88, are sent to the server 100 together, as the game result information (equivalent to a result of random determination in the present invention). For Example, when the "Speed Spin (10 Games)" item is used, the steps S82 to S90 are executed 10 times. In this case, results of the slot game executed 10 times, such as the number of coins betted in S83 (in 10 executions), the five to-be-stopped symbols determined in S84 (in 10 executions), and a payout awarded in S88 (in 10 executions), are sent to the server 100 together, as the game result information (equivalent to a result of random determination in the present invention). Thereafter, the stock area of the RAM 103 is initialized and the process ends.

In the present embodiment, also in S88, whether a win with "BONUS" (3Kinds of "BONUS", 4Kinds of "BONUS", or 5Kinds of "BONUS") is achieved is determined. When the "BONUS" win is achieved, the free game is executed. At this stage, when the "Speed Spin" item has been used, a touch input to the spin button 241 is required to start the free game, in the same manner as in the case where an item related to speed spin has not been used (i.e., neither the "Speed Spin" item nor the "High Speed Spin" item has been used). Meanwhile, when the "High Speed Spin" item has been used, no touch input to the spin button 241 is required to start the free game, and the free game is automatically and successively repeated the awarded number of times.

(Server Backup Process)

Figure 9:
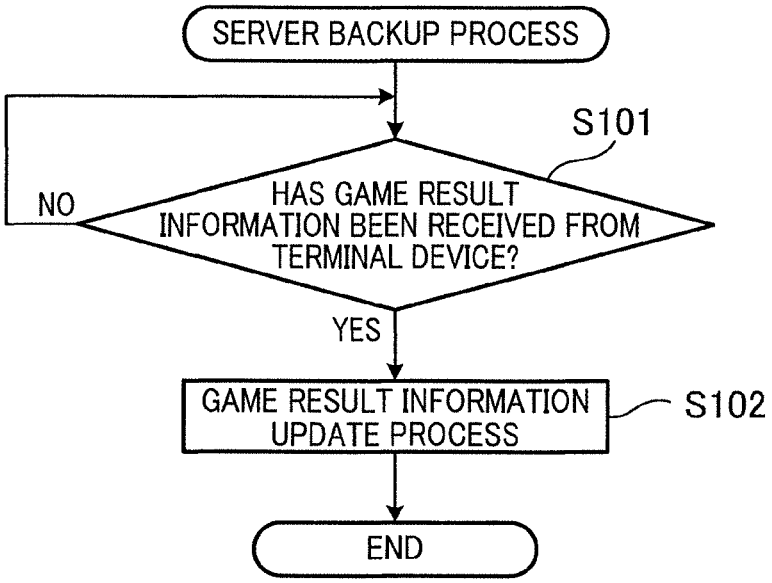
FIG. 9 shows a flowchart of a server backup process.

The following will describe a server backup process with reference to FIG. 9.

The control unit 131 of the server 100 determines whether game result information has been received from the smartphone 1 (terminal device) (S101). When the game result information has not been received (NO in S101), the sending of the information is waited for.

Meanwhile, when the game result information has been received (YES in S101), the control unit 131 executes a game result information update process (S102). In this game result information update process, the user is specified based on the identification number of the smartphone 1 which has sent the game result information, and the game result information of each user is stored in the storage unit 132. This makes it possible to store results of each execution of a slot game on each smartphone 1, such as the number of betted coins, selected five to-be-stopped symbols, and an awarded payout, in the storage unit 132 as the game result information of each user. Then, this process is terminated.

According to the arrangement above, in the normal slot game control process (see S20), the server 100 receives game result information which is sent from each of the smartphones 1 of many users each time one execution of the slot game (unit game) is finished, and stores, in the storage unit 132, the state of progress of the game based on the game result information. Meanwhile, when an item related to the speed up such as the "Speed Spin" item and the "High Speed Spin" item is used in a smartphone 1 and the routine shifts to the speedup slot game control process in which the progress speed of the slot game is accelerated (i.e., when the game acceleration instruction is made), the server 100 receives, from the smartphone 1, results of the slot game having been executed the number of times corresponding to the value of the speedup game counter updated in S81, together as game result information. The server 100 stores, in the storage unit 132, the state of progress of the game based on the received game result information.

As such, even when the progress speed of the slot game is accelerated, the number of times of data communication per unit time between the server 100 and each smartphone 1 is suppressed, with the result that access concentration to the server 100 is suppressed.

In addition to the above, according to the embodiment above, the "Speed Spin" item or the "High Speed Spin" item by which the progress speed of the slot game is accelerated is awarded to the smartphone 1 in the advancement of the slot game, as a benefit awarded as a result of the slot game, or in exchange for coins in the shop (predetermined condition), and when such an item is used, the routine shifts to the speedup slot game control process (i.e., the game acceleration instruction is made).

In this way, when the "Speed Spin" item or the "High Speed Spin" item which is awarded if the predetermined condition is satisfied during the progress of the slot game is used in the slot game, the progress speed of the slot game is accelerated. On this account, even when a function in which the progress speed of the slot game is accelerated and the number of times of data communication per unit time between the server 100 and each smartphone 1 is increased is employed, it is possible to restrict the valid time of this function (i.e., the time from the use of the "Speed Spin" item or the "High Speed Spin" item to the expiry of the effect of the item), with the result that access concentration to the server 100 is suppressed.

Other Embodiments

While in the embodiment above the slot game is executed by the server 100, the slot game may be, as game software (a program and game data), installed in and executed by an information processor. Examples of the information processor include mobile information devices such as a smartphone, a portable computer, a laptop computer, a note PC, a tablet PC, a handheld PC, and a PDA (Personal Data Assistant). The game software by which the slot game is executed is downloaded from a server or the like via communication means and stored in a storage device (e.g., a flash memory) in the mobile information device. The communication means may be an interactive communication passage such as the Internet and a cable TV, or may be one-way broadcasting.

The game software by which the slot game is executed may be stored in a recording medium such as a CD-ROM, a DVD-ROM, an MO (optical magnetic disc), a hard disk, and a flash memory, and may be read from the recording medium and installed in a storage device of a information processor such as the server 100 and the smartphone 1, according to need.

The disclosure of the embodiment above may be embodied as a game program which is executed between each smartphone 1 and the server 100 over the Internet (communication line). In this case, the game program may be stored in a recording medium such as a CD-ROM, a DVD-ROM, an MO (optical magnetic disc), a hard disk, and a flash memory, and may be read from the recording medium according to need.

The processes executed in the embodiment above may be a game program installed in the terminal device (smartphone 1). In this case, the game program causes the terminal device (smartphone 1) to execute the following processes while a game of awarding a benefit based on a random determination result is executed:

each time random determination for determining the content of a benefit is executed, sending a result of the random determination to the information processor (server 100); and when a game acceleration instruction is made to accelerate the progress of the game, sending results of a predetermined number of times of execution of the random determination together to the information processor.

Embodiments of the present invention thus described above solely serve as specific examples of the present invention, and are not to limit the scope of the present invention. The specific structures and the like are suitably modifiable. Further, the effects described in the embodiments of the present invention described in the above embodiment are no more than examples of preferable effects brought about by the present invention, and the effects of the present invention are not limited to those described hereinabove.

What is claimed is:

1. An information processor which provides a game in which a benefit is awarded as a result of random determination to a terminal device over a communication line, comprising:

a storage unit configured to store a result of the random determination for each terminal device; and a controller which is programmed to execute the processes of:

(a) receiving, from the terminal device, a result of the random determination of determining content of the benefit, which is sent each time the random determination is executed;

(b) storing, in the storage unit, the result of the random determination received in the process (a);

(c) when a game acceleration instruction for accelerating progress of the game is made in the terminal device, receiving results of a predetermined number of times of execution of the random determination, which are sent together from the terminal device; and (d) storing, in the storage unit, the results of the predetermined number of times of execution of the random determination, which are received in the process (c).

2. The information processor according to claim 1, wherein, in the terminal device, an item for accelerating the game is awarded when a predetermined condition is satisfied, and the game acceleration instruction is made when the item for accelerating the game is used.

3. A non-transitory recording medium storing a game program which is executed between a terminal device and an information processor over a communication line, when a game in which a benefit is awarded as a result of random determination is executed, the game program causing:

(a) the terminal device to send a result of the random determination for determining content of the benefit to the information processor, each time the random determination is executed;

(b) the information processor to store the result of the random determination received in (a) in a storage unit;

(c) the terminal device to send results of a predetermined number of times of execution of the random determination together to the information processor, when a game acceleration instruction is made to accelerate the progress of the game; and (d) the information processor to store, in the storage unit, the results of the predetermined number of times of execution of the random determination, which are received in (c).

* * * * *